US009242784B2

(12) United States Patent
Buck et al.

(10) Patent No.: US 9,242,784 B2
(45) Date of Patent: Jan. 26, 2016

(54) METERING AND MIXING DEVICE FOR MULTI-COMPONENT SUBSTANCES

(71) Applicant: Sika Technology AG, Baar (CH)

(72) Inventors: Manuel Buck, Gebenstorf (CH); Andreas Hufschmid, Aarau (CH)

(73) Assignee: SIKA TECHNOLOGY AG, Baar (CH)

( * ) Notice: Subject to any disclaimer, the term of this patent is extended or adjusted under 35 U.S.C. 154(b) by 4 days.

(21) Appl. No.: 13/924,884

(22) Filed: Jun. 24, 2013

(65) Prior Publication Data

US 2013/0277390 A1 Oct. 24, 2013

Related U.S. Application Data

(63) Continuation of application No. PCT/EP2011/073576, filed on Dec. 21, 2011.

(30) Foreign Application Priority Data

Dec. 24, 2010 (EP) ..... 10196972

(51) Int. Cl.
*B67D 7/70* (2010.01)
*B65D 83/00* (2006.01)
(Continued)

(52) U.S. Cl.
CPC ..... *B65D 83/0011* (2013.01); *B05C 17/00553* (2013.01); *B05C 17/00556* (2013.01);
(Continued)

(58) Field of Classification Search
CPC ..... B65D 83/0011; B05C 17/00553; B05C 17/00556; B05C 17/00566; B05C 17/00576; B05C 17/00579; B05C 17/00583; B05C 17/00596; B05C 17/0103; B05C 17/012; B05C 17/0133
USPC ..... 222/135–137, 145.1–145.6, 325–327, 222/386–393
See application file for complete search history.

(56) References Cited

U.S. PATENT DOCUMENTS 1,756,811 A * 4/1930 Brownsberger et al. ..... 222/390
2,328,973 A * 9/1943 Goldfisher ..... 401/11
(Continued)

FOREIGN PATENT DOCUMENTS

CN 1516625 A 7/2004
CN 2638853 Y 9/2004
(Continued)

OTHER PUBLICATIONS

Notification of Transmittal of Copies of Translation of the International Preliminary Report on Patentability (Chapter I or Chapter II)(PCT/IB/338), International Preliminary Report on Patentability (Form PCT/IB/373) and Written Opinion of the International Searching Authority (Translation)(Form PCT/ISA/237) issued on Jul. 4, 2013, in corresponding International Application No. PCT/EP2011/073576. (9 pages).
(Continued)

*Primary Examiner* — Patrick M Buechner
(74) *Attorney, Agent, or Firm* — Buchanan Ingersoll & Rooney PC

(57) ABSTRACT

A metering and mixing device is disclosed for multi-component substances, such as multi-component adhesives, which includes at least two associated cartridge accommodating devices for accommodating replaceable cartridges having individual substance components, a discharging device for disclosing (e.g., simultaneously discharging) the substance components from the cartridges through component outlets by discharging pistons that plunge into the cartridge accommodating device or cartridges, and a mixing device, which is connected to the component outlets, mixes the discharged substance components, and outputs the substance components in the mixed state. At least one discharging piston can have a thread such that the discharging piston can be driven forward by the thread when the discharging piston is rotated relative to the cartridge accommodating device.

20 Claims, 4 Drawing Sheets

(51) Int. Cl.
*B05C 17/005* (2006.01)
*B05C 17/01* (2006.01)

(52) U.S. Cl.
CPC ..... *B05C17/00566* (2013.01); *B05C 17/00576* (2013.01); *B05C 17/00579* (2013.01); *B05C 17/00583* (2013.01); *B05C 17/00596* (2013.01); *B05C 17/012* (2013.01); *B05C 17/0103* (2013.01); *B05C 17/0133* (2013.01)

(56) References Cited

U.S. PATENT DOCUMENTS

| | | | | | |
|---|---|---|---|---|---|
| 2,335,049 | A | * | 11/1943 | Finkelstein | 222/390 |
| 2,599,379 | A | * | 6/1952 | Gabler | 222/327 |
| 3,187,951 | A | * | 6/1965 | Hardman et al. | 222/102 |
| 3,330,444 | A | * | 7/1967 | Raypholtz | 222/137 |
| 3,532,316 | A | | 10/1970 | Mathes | |
| 3,570,719 | A | * | 3/1971 | Schiff | 222/137 |
| 3,598,293 | A | * | 8/1971 | Lee | 222/327 |
| 4,471,888 | A | * | 9/1984 | Herb et al. | 222/137 |
| 4,840,294 | A | * | 6/1989 | Ernst | 222/287 |
| 4,871,088 | A | * | 10/1989 | Cox | 222/47 |
| 5,033,650 | A | * | 7/1991 | Colin et al. | 222/137 |
| 5,042,696 | A | * | 8/1991 | Williams | 222/340 |
| 5,104,005 | A | * | 4/1992 | Schneider et al. | 222/137 |
| 5,161,715 | A | * | 11/1992 | Giannuzzi | 222/82 |
| 5,184,757 | A | * | 2/1993 | Giannuzzi | 222/82 |
| 5,242,082 | A | * | 9/1993 | Giannuzzi | 222/82 |
| 5,263,614 | A | * | 11/1993 | Jacobsen et al. | 222/137 |
| 5,992,705 | A | * | 11/1999 | Lhuisset | 222/386 |
| 6,048,201 | A | * | 4/2000 | Zwingenberger | 433/90 |
| 6,089,407 | A | * | 7/2000 | Gardos | 222/137 |
| 6,176,396 | B1 | * | 1/2001 | Hamada et al. | 222/137 |
| 6,186,363 | B1 | * | 2/2001 | Keller et al. | 222/145.6 |
| 6,234,348 | B1 | * | 5/2001 | Okamura et al. | 222/1 |
| 6,352,177 | B1 | * | 3/2002 | Bublewitz et al. | 222/82 |
| 6,386,396 | B1 | * | 5/2002 | Strecker | 222/261 |
| 6,394,643 | B1 | * | 5/2002 | Bublewitz et al. | 366/172.1 |
| 6,523,992 | B1 | * | 2/2003 | Bublewitz et al. | 366/172.1 |
| 6,769,574 | B1 | * | 8/2004 | Keller | 222/137 |
| 6,892,908 | B2 | * | 5/2005 | Ichikawa et al. | 222/567 |
| 7,320,541 | B2 | * | 1/2008 | Wagner et al. | 366/172.1 |
| 8,371,744 | B2 | * | 2/2013 | Walter et al. | 366/331 |
| 8,544,683 | B2 | * | 10/2013 | Springhorn et al. | 222/1 |
| 2001/0004082 | A1 | * | 6/2001 | Keller et al. | 222/137 |
| 2003/0123323 | A1 | * | 7/2003 | Bublewitz et al. | 366/172.1 |
| 2004/0216591 | A1 | | 11/2004 | Assadi et al. | |
| 2004/0260304 | A1 | | 12/2004 | Faccioli et al. | |
| 2005/0139616 | A1 | * | 6/2005 | Ichikawa et al. | 222/325 |
| 2010/0200617 | A1 | * | 8/2010 | Schar | 222/387 |
| 2011/0309111 | A1 | * | 12/2011 | Helmenstein | 222/386 |
| 2013/0277390 | A1 | * | 10/2013 | Buck et al. | 222/80 |
| 2013/0277393 | A1 | * | 10/2013 | Rahm et al. | 222/137 |
| 2013/0341352 | A1 | * | 12/2013 | Williams | 222/95 |
| 2014/0224835 | A1 | * | 8/2014 | Tobler et al. | 222/94 |
| 2014/0301153 | A1 | * | 10/2014 | Buck et al. | 366/130 |
| 2014/0301156 | A1 | * | 10/2014 | Rahm et al. | 366/184 |

FOREIGN PATENT DOCUMENTS

| | | | |
|---|---|---|---|
| CN | 1615110 | A | 5/2005 |
| CN | 201200946 | Y | 3/2009 |
| DE | 3233366 | A1 | 9/1983 |
| DE | 102008036643 | A1 | 2/2010 |
| EP | 2324792 | A1 | 5/2011 |

OTHER PUBLICATIONS

*International Search Report (PCT/ISA/210) Issued on Mar. 8, 2012, by the European Patent Office as the International Searching Authority for International Application No. PCT/EP2011/073576.

*Written Opinion (PCT/ISA/237) Issued on Mar. 8, 2012, by the Japanese Patent Office as the International Searching Authority for International Application No. PCT/EP2011/073576.

First Office Action issued Mar. 31, 2015 by the Chinese Patent Office in corresponding Chinese Application No. 201180061645.0, and an English translation thereof (13 pages).

* cited by examiner

METERING AND MIXING DEVICE FOR MULTI-COMPONENT SUBSTANCES

RELATED APPLICATION(S)

This application claims priority as a continuation application under 35 U.S.C. §120 to PCT/EP2011/073576, which was filed as an International Application on Dec. 21, 2011 designating the U.S., and which claims priority to European Application 10196972.3 filed in Europe on Dec. 24, 2010. The entire contents of these applications are hereby incorporated by reference in their entireties.

FIELD

The disclosure relates to a metering and mixing device for multi-component substances, such as multi-component adhesives having at least two associated cartridge accommodating devices of hollow cylindrical shape for accommodating individual substance (e.g., adhesive) components, a discharging device for discharging (e.g., simultaneously discharging) the adhesive components from the cartridges through cartridge outlets by discharging pistons that plunge into the cartridge, and a mixing device which is connected to the cartridge outlets, mixes the discharged substance components and outputs them in the mixed state.

BACKGROUND INFORMATION

A metering and mixing device is known, for example, from the document DE 32 33 366 A1, for mixing a dental impression material made of two pasty components. The device described therein for mixing the components of a dental impression material includes a mixer designed as a disposable part and having a base body. The mixer includes a mixing chamber, several feed channels for components of impression material which open separately from each other into the mixing chamber, as well as an outlet opening for the mixed impression material. The mixer includes a mixer part which is rotatably arranged in the mixing chamber and driven by a driving device to which the mixer is secured detachably. The components of the impression material are contained in reservoir cylinders and they are pushed by pistons into the mixing chamber, and pushed out after the mixing via the outlet opening into the impression spoon. By way of a control unit, the rate of advance can be varied by the setting actuators of the pistons, so that both the ratio of the piston advance rate which determines the curing time of the impression material and also the total advance or the duration of the advance, and thus the impression material quantity, can be controlled.

Such metering and mixing devices can have issues with metering accuracy, for example, at high quantitative ratios of the individual components, such as 50:1 or higher, for example.

U.S. Pat. No. 6,176,396 B1 describes a metering and mixing device for multi-component substances, in particular multi-component adhesives, with a single cartridge accommodating device, for accommodating replaceable cartridges having individual substance components, a discharging device for simultaneously discharging the substance components from the cartridges through the component outlets by way of discharging pistons that plunge into the cartridge accommodation device or cartridges, and a mixing device connected to the component outlets which mixes the discharge substance components and outputs them in the mixed state. For driving the discharging pistons, a threaded bar is used in each case, which is introduced into a thread located in a central position in the discharging piston, and which moves the discharging piston forward by the simultaneous rotation of the threaded bars relative to the respective discharging piston. With this metering and mixing device, the threaded bars have to already be plunged with their full length into the individual components to be mixed, and thus, for example, simple tubular cartridges can no longer be used in a simple manner; instead special cartridges are involved which must already have, within their central inner space, the space needed for the threaded bars extending through the cartridges.

SUMMARY

A metering and mixing device is disclosed for a multi-component substance, comprising: at least two associated cartridge accommodating devices for accommodating replaceable cartridges having individual substance components; a discharging device for parallel discharging the substance components from cartridges through component outlets by means of discharging pistons that plunge into the cartridge accommodating device or cartridges; and a mixing device, which is connected to the component outlets, for mixing the discharge substance components, and outputting them in a mixed state, wherein: at least one of the discharging pistons has a thread such that the discharging piston will be driven forward by the thread when the discharging piston is rotated relative to the cartridge accommodating device.

BRIEF DESCRIPTION OF THE DRAWINGS

The disclosure will be described in further detail using exemplary embodiments with reference to the figures, wherein features required to understand the disclosure are represented. The disclosure is, however, not limited to the depicted and described exemplary embodiments.

The figures show in detail.

DETAILED DESCRIPTION

Figure 1:
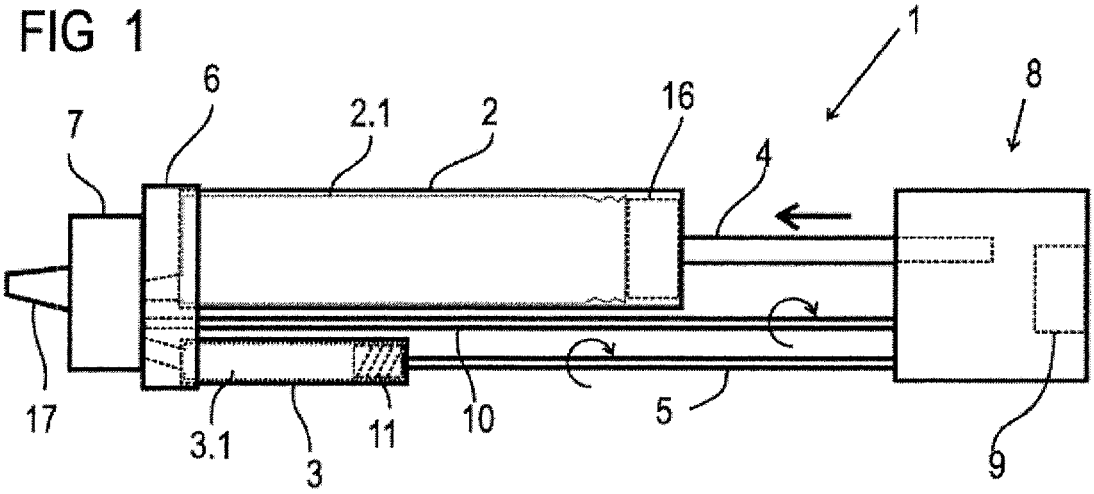
FIG. 1: A side view of an exemplary metering and mixing device according to the disclosure for a 2-component adhesive.

The present disclosure is directed to a metering and mixing device for multi-component substances, such as for multi-component adhesives, which can meet high accuracy specifications even in the case of large quantitative differences with regard to the mixture of the components and even under simple production conditions of the corresponding metering and mixing device.

The inventors have recognized that an issue in the accurate metering of several components, such as with regard to the components that account for only a small proportion of the mixture, exists due to the very simple forward driving of the respective piston in the cartridges having components that account for a small proportion of the mixture.

According to exemplary embodiments not only a simple linear forward driving of the piston is used, but this piston can also be provided with a thread which can ensure that by a defined rotation of the piston a corresponding forward driving is produced. Due to a very simple thread pitch that can be defined with precision, this forward driving can also be adjusted very individually based on the specifications of the respective mixing ratio of the individual components to be combined.

It can be particularly simple here if the piston is provided with an outer thread which is moved forward, into the inner cylinder of the respective cartridge accommodating device or of the cartridge in which the component to be metered is located, when the piston is rotated correspondingly. Here, it is as a rule not necessary to provide an inner thread within the cartridge. It is sufficient if the thread of the piston produces by self-cutting or self-punching a corresponding negative thread on the inner wall of the cartridge or cartridge accommodating device. It can also be particularly advantageous if, in the exemplary case of a two-component metering and mixing device, a cartridge accommodating device in which the material component to be metered in a respective high quantity is located, for example, in a tubular bag, is driven forward by means of a linear drive train for the piston, while the cartridge accommodating device which contains the material to be metered very sparingly, for example, in a hard cylindrical cartridge, is moved forward with the piston having a thread configuration according to the disclosure by a rotation of the piston.

In accordance with this basic concept, a metering and a mixing device is disclosed for multi-component substances, such as multi-component adhesives, which comprise at least two associated cartridge accommodating devices for accommodating individual substance components, a discharging device for parallel discharging (e.g., simultaneously discharging such as in parallel or partially overlapping time sequence) the substance components from the cartridges through component outlets by means of discharging pistons that plunge into the cartridge accommodating device or cartridges, and a mixing device connected to the cartridge outlets which mixes the discharged substance components and outputs them in the mixed state.

An exemplary improvement according to the present disclosure accordingly can include at least one discharging piston having a thread which can drive the discharging piston forward by a rotation of the driving piston.

For definition of the terms, it is noted that, in the sense of this document, a cartridge denotes for example, any container, such as a replaceable container, which can contain one of the substance components. For example, the containers can be cylindrical containers having a relatively hard wall, or also tubular bags.

Thus, at least one cartridge can, for example, be configured as a hollow cylinder in which at least one substance component is located. In such an embodiment, the thread of the at least one discharging piston having a thread can be in contact with the wall of the at least one hollow cylindrical cartridge.

Moreover, at least one cartridge can be a tubular bag in which at least one substance component is located. Here, the thread of the at least one discharging piston having a thread for this cartridge accommodating device in which a tubular bag is inserted as a cartridge can then be in contact with a wall of the cartridge accommodation device.

Moreover, at least one of the cartridge accommodating devices can have a hollow cylinder or at least be configured as a hollow cylinder. However, alternatively it is also possible for at least one cartridge accommodating device to have, for example, at least three cylindrically arranged bar-like supports into which a sufficiently stable cartridge can be inserted.

Using a discharging piston which has a thread, and the forward driving of which is determined by a rotation of the thread, a very precise metering can be produced in a very simple manner, by adapting, on the one hand, the thread pitch, and, on the other hand, the circumferential speed of the driving shaft depending on the desired metering.

In principle it can be advantageous if the discharging piston, which in the end is to plunge into the cartridge in order to discharge the material contained therein through a cartridge outlet, has its thread on the outer side, so that the thread can punch into the inner side of the cylindrical cartridge or cartridge accommodating device, and it thus determines the forward driving. However, it is also possible to use an alternative such as a slightly more expensively configured piston which has, on its rear side, a connection to a cylinder located outside the cartridge, wherein the cylinder in turn has an inner thread which bears against the outer side of the cartridge, and in this manner, by a rotation of the entire discharging piston, it punches its thread on the outside of the cartridge or the cartridge accommodating device, and consequently produces an advance due to a rotation relative to the cartridge or the cartridge accommodating device, the advance of which discharges the material located in the cartridge through a component outlet.

As already mentioned, it can be advantageous if, in the at least one cartridge or cartridge accommodating device in which the at least one discharging piston with outer thread is located, there is already a negative thread with respect to the outer thread of the discharging piston. As a result, the force exerted for driving the discharging piston forward can be slightly smaller. On the other hand, the possibility exists to configure the outer thread of the at least one discharging piston so that it is self-cutting, in such a manner that said discharging piston itself cuts or punches a negative thread during a rotation.

It can be particularly advantageous to use a metering and mixing device in which a combination of, for example, smaller cartridge in which a discharging piston having a thread is located, and an additional cartridge accommodating device with a linear driven discharge bar for the discharging piston located therein, which can be discharged through the a tubular bag located therein, having, for example, a substantially larger metering proportion than in the smaller cartridge.

The linearly forward driven discharge bar can have a regular toothing with which a gear wheel or a spindle thread can engage for the forward driving. Alternatively, the linearly driven discharge bar itself conversely can also have a spindle thread with which an outer toothing can engage.

Moreover, in the metering and mixing device configured according to an exemplary embodiment, at least one gear drive for driving the discharging piston can also be provided, wherein, in an exemplary embodiment, a common gear drive can be provided with a drive input and several drive outputs for driving at least the driving pistons.

With such a gear drive it is possible to connect, on the one hand, at least one linearly movable discharging piston and at least one discharging piston that can be moved in rotation. This can be particularly advantageous if a common gear drive through a common drive input comprises, on the one hand, a transmission to a linear forward driving, using, for example, a bevel wheel drive or a gear drive or a spindle drive, and, on the other hand, it comprises a rotating output, wherein a shaft can be driven in rotation, in order to drive in rotation the discharging piston provided with a thread.

In an exemplary metering and mixing device according to the disclosure, the mixing device can be configured moreover both as a passive or static mixer or alternatively as an active or dynamic mixer, such as a rotary mixer.

In an exemplary embodiment of a mixing device as an active or dynamic mixer, the mixer be connected to a gear drive, such as to the gear drive for driving the discharging piston. As a result, the possibility exists to use a single common gear drive, for example, an electric motor, to drive, by means of the different drive outputs, on the one hand, a linear forward driving, and, on the other hand, a rotational driving for a discharging piston having a thread, and, to operate a rotary mixer. Here, it can be ensured that both the discharging and also the active mixing of the individual components are carried out with mutual adaptation.

With regard to exemplary discharging pistons according to the disclosure, such as the discharging piston having a thread, they can comprise at least one ventilation device in the area of the discharging piston itself, or alternatively at least one of the cartridges or cartridge accommodating devices into which the discharging piston is introduced, can comprise a ventilation device. As a result, it is possible in particular to countersink, as a ventilation device, in the rear portion of the cartridge inner side or cartridge accommodation device, at least one ventilation groove, so that excess air can escape to the side over at least a portion of the discharge section.

Moreover, in an exemplary embodiment of the metering and mixing device, it is proposed that at least two of the cartridge accommodating devices be configured so that they have different lengths and/or so that at least two of the cartridge accommodating devices have different diameters. The design with different lengths of the cartridge accommodating devices can be compensated without problems by applying a corresponding thread pitch to the discharging piston(s), wherein, in addition or alternatively, by means of the different diameters, the different metering of the individual substance components can be taken into consideration.

Moreover, it is proposed that at least one gear drive can be driven by a motor, such as by an electric motor.

The cartridge accommodating devices with discharging pistons and adhesive components can also be connected to form one unit, and the mixer and the at least one gear drive can be configured so they can be attached or docked or clipped on separately.

FIG. 1 shows a side view of an exemplary metering and mixing device 1 according to the disclosure, including, as examples, two cartridge accommodating devices 2 and 3 having different diameters and different lengths for a tubular bag 2.1 and a hard cartridge 3.1. The larger cartridge accommodation device 2 is actuated by means of a linear piston 16 which is connected to a toothed bar 4 and driven linearly forward by the latter into the cartridge accommodating device 2 by means of a gear drive 8. The cartridge accommodating device 3, which has a substantially smaller diameter and which is moreover substantially shorter than the cartridge accommodating device 2, can, for example, be actuated according to the disclosure by a rotary piston which, on the outer side, has a thread that punches into the inner side of the cartridge accommodating device 3 or of a cartridge 3.1 inserted there, and which produces, due to its rotation, a forward driving of the discharging piston configured as a rotary piston. This rotary piston 11 is driven by a rotary shaft 5 which is connected to the gear drive 8 which, in the case of a single drive input side, can have three different drive output sides. They are, on the one hand, an output for the linearly forward driven toothed bar 4, and, on the other hand, an output for the rotating rotary shaft 5, and an output for the rotating drive shaft 10 which drives a rotary mixer 7. The two cartridge accommodating devices 2 and 3 are connected on the output side to a cartridge coupling 6, through which the material located in the cartridge accommodating devices 2 and 3 is conveyed from the component outlets to the rotary mixer 7, which is also connected to the cartridge coupling 6. The general design of such a rotary mixer is known. It can include, in addition, a discharge tip 17 arranged at the front, through which the mixed material is discharged in the end.

The gear drive 8 in the exemplary embodiment of the dosing and mixing device 1 depicted can be driven by means of an electric motor 9.

Figure 2:
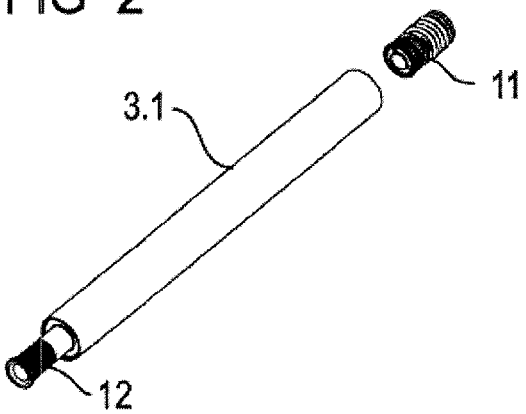
FIG. 2-FIG. 3: 3D views of an exemplary small cylindrical cartridge with a hard outer wall, a rotary piston and a discharge spout.
Figure 3:
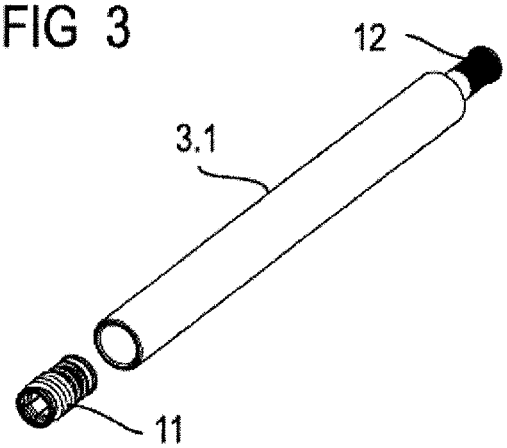

FIGS. 2 and 3 show in detail two exemplary 3D representations oriented in opposite directions of a small cartridge 3.1 which is inserted in the cartridge accommodating device 3 of FIG. 1. Using a rotary piston 11 provided for this purpose, which is provided on the outer side with a thread and rotated into the small cartridge 3.1, the discharge of the material within the cartridge 3.1 through a discharge spout 12 can be generated in a manner which can be metered very precisely.

Figure 4:
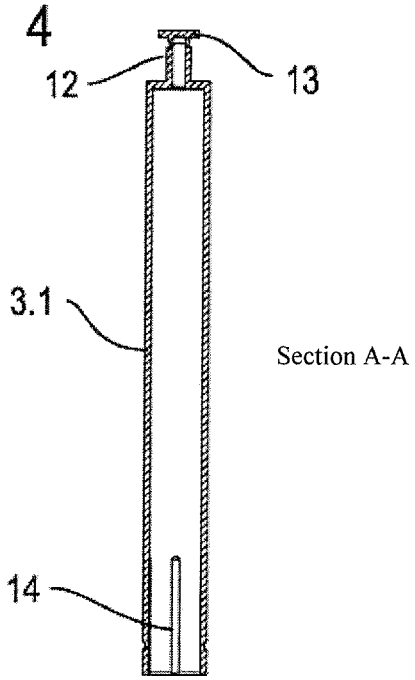
FIG. 4: A longitudinal section through an exemplary cylindrical cartridge with a hard outer wall, an interior ventilation groove, and, on a discharge spout, a closure which can be sheared off.

In FIG. 4, a further exemplary embodiment of a cylindrical cartridge 3.1 with a hard outer wall is shown, into which a rotary piston with its thread can be screwed. In addition, at the lower end of the cartridge 3.1, on which the rotary piston is set, a ventilation groove 14 is shown, which is used to allow excess air to escape when the piston is rotated inward, so that, in the end, the rotary piston sits directly on the material component to be discharged and above all to be metered with precision. Air inclusions could here be counterproductive in terms of achieving the most precise metering capacity possible, because, as a result of the compressibility of the air, hysteresis events between the actuation of the piston and the actually exiting material quantity would occur in each case.

In addition, on this cartridge 3.1, an exemplary closure system of the cartridge can also be seen, wherein, in the manufacture of the cartridge, a closure 13 is connected to the discharge spout 12 so as to form a single piece. For opening, the closure 13, optionally with the assistance of an appropriate tool, can be sheared off the discharge spout by twisting, so that a discharge opening forms in the discharge spout. Such a closure is known, for example, in the field of toothpaste tubes.

Figure 5:
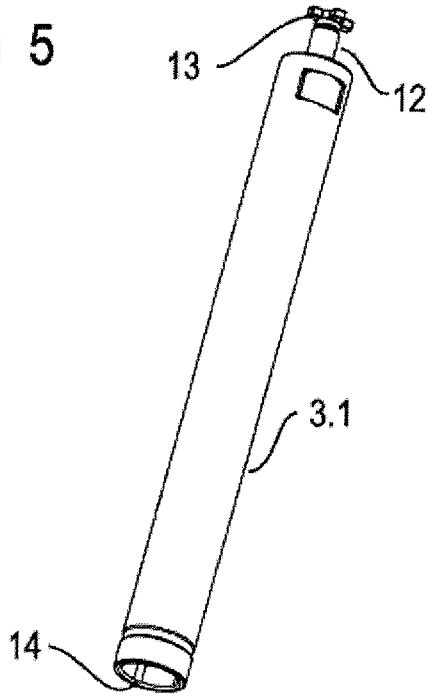
FIG. 5: Exemplary cartridge of FIG. 4 in a 3D representation.

In FIG. 5, the cartridge 3.1 of FIG. 4 is shown again in a 3D representation.

Figure 6:
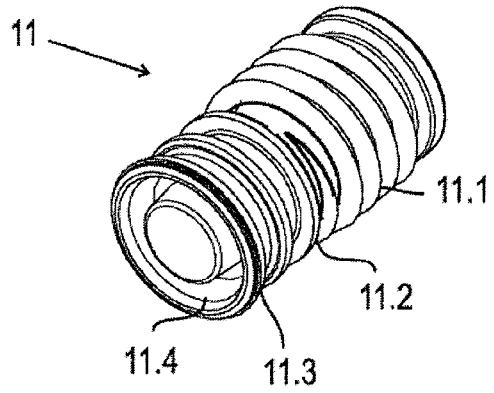
FIG. 6-FIG. 14: Exemplary embodiment variants of a rotary piston with outer thread.
Figure 7:
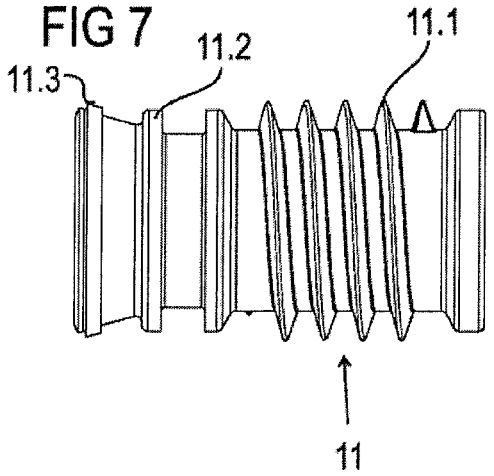

Furthermore, the rotary piston 11 is shown in detail in different additional exemplary embodiments in FIGS. 6-14, wherein FIGS. 6 and 7 depict a variant that can be produced as a single piece, in which on the rotary piston 11 itself, in the rear area, a thread 11.1 is arranged, followed then in the forward direction by two delimiting rings between which an O-ring for additional sealing can be inserted, and the sealing ring 11.3 itself at the front end of the rotary piston. On the front side of the rotary piston, in FIG. 6, an air inclusion area 11.4 can be seen, in which excess air can be held, without any negative effect on the precise metering capacity of the entire system.

Figure 8:
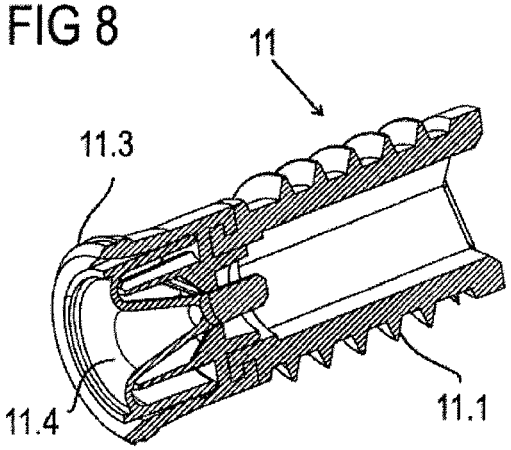
Figure 9:
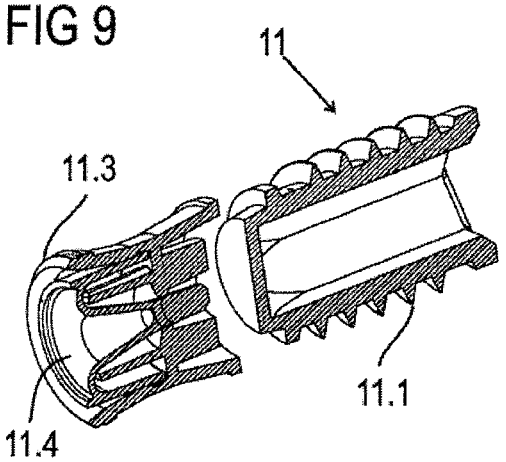

FIG. 8 shows another exemplary variant of the rotary piston as a 2K injection molding product. FIG. 9 shows a two-part embodiment with a known piston at the front and a threaded sleeve arranged at the rear, on which the outer thread 11.1 is produced.

Figure 10:
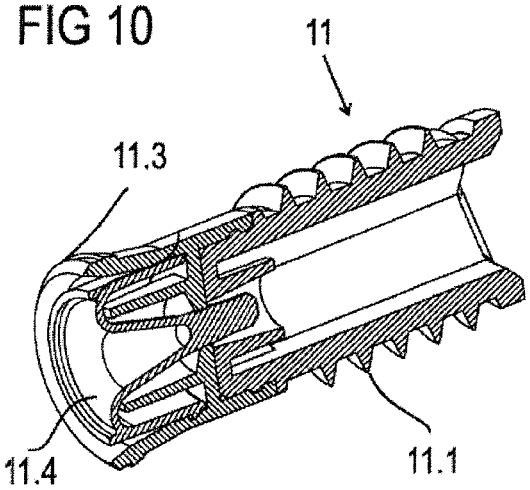
Figure 11:
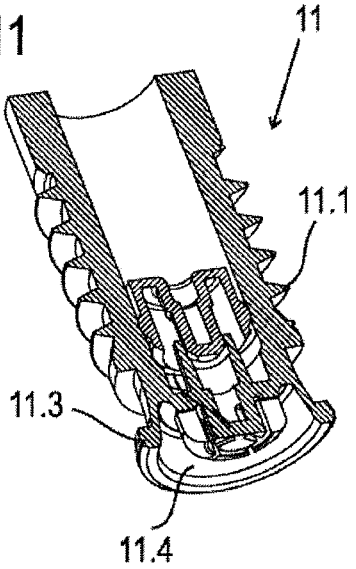
Figure 12:
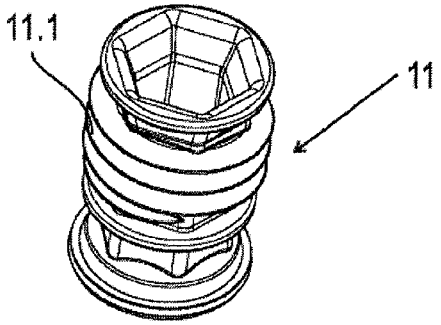
Figure 12A:
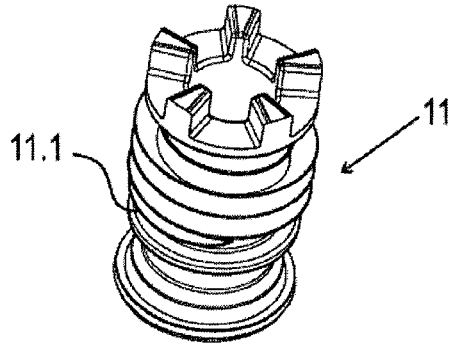
Figure 13:
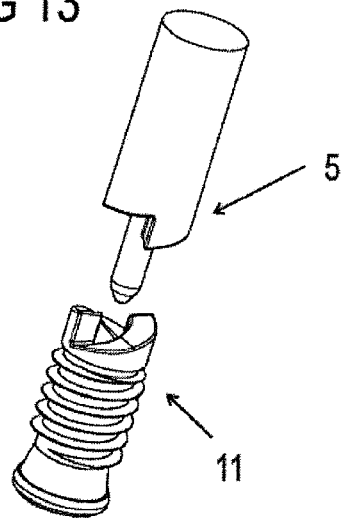
Figure 14:
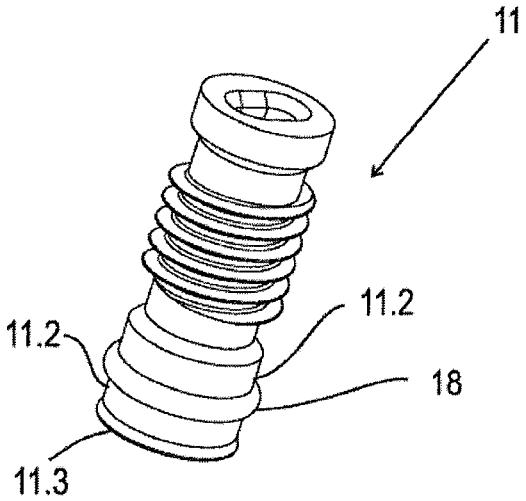

In FIG. 10, a single-piece piston with a hard sealing lip 11.3 at the front is shown, while in FIG. 11, an exemplary embodiment variant of a rotary piston with an integrated ventilation in the piston itself is shown. FIGS. 12-14 show different variants of connection of the rotary piston 11 according to the disclosure to a rotary shaft. In FIG. 12, a variant with a simple inner hexagonal recess is shown, into which a corresponding hexagonal head is introduced. Alternatively, FIG. 12*a* shows a connection with five claws protruding upward, with which a corresponding counter piece can engage.

Figure 13A:
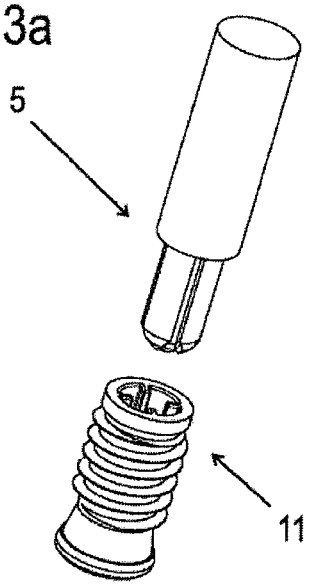

FIG. 13 shows an exemplary embodiment in which the closure portion of the rotary piston 11 and the closure portion of the rotary shaft 5 are designed so that the latter can be maneuvered into the correct position, without special assistance, during the mounting itself, and produce a nonpositive-locking connection. Alternatively, the rotary piston 11 in FIG. 13*a* is configured with four bars located on the inside, into which a corresponding counter piece on the shaft 5 can be inserted and with which it can engage with positive-locking connection.

FIG. 14 again shows an exemplary embodiment of a rotary piston, similar to FIGS. 6 and 7, wherein here the O-ring 18 is already arranged between the two delimitations 11.2. In the rear area of the piston, a rounded longitudinal recess can be seen, which can also be used as a positive-locking connection for a rotary shaft, wherein the round outer area in addition can be used, for example, in order to circumferentially clip an outer ring of the rotary shaft to the piston, so that the rotary shaft is moved forward with this piston when the piston advances.

In FIGS. 15 and 16, and 17 and 18, two different exemplary cartridge couplings 6 are represented in detail, respectively. These cartridge couplings 6, on their rear side, each have two insertion flanges 19.1 and 19.2, into which the large cartridge and the small cartridge are inserted. In the insertion flange 19.1 and 19.2, in each case, two outlet openings 20.1 and 20.2 are arranged, from which the material contained in the cartridges can be led to a connected mixer. In addition, the cartridge couplings 6 also have a drive train aperture 21, through which the drive shaft coming from the gear drive can be led to the rotary mixer.

Figure 15:
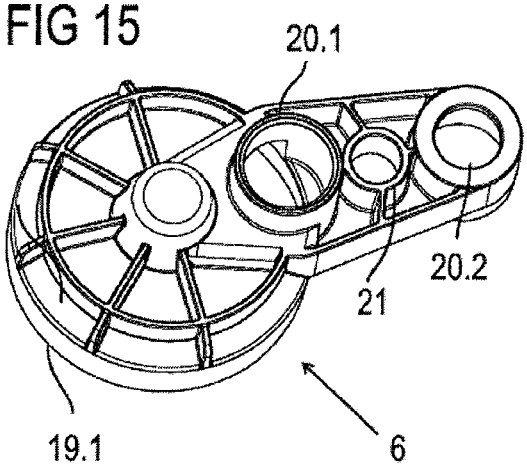
FIG. 15-FIG. 16: Exemplary variant of a cartridge coupling in two 3D views.
Figure 16:
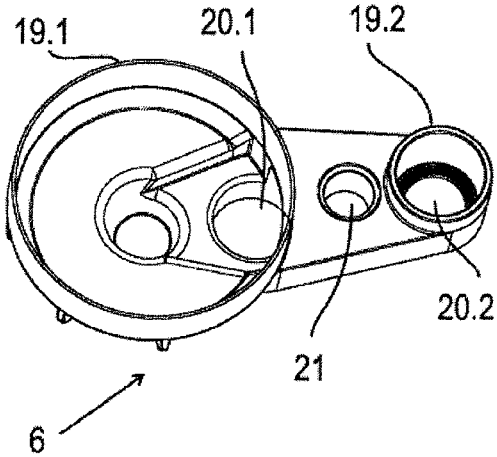
Figure 17:
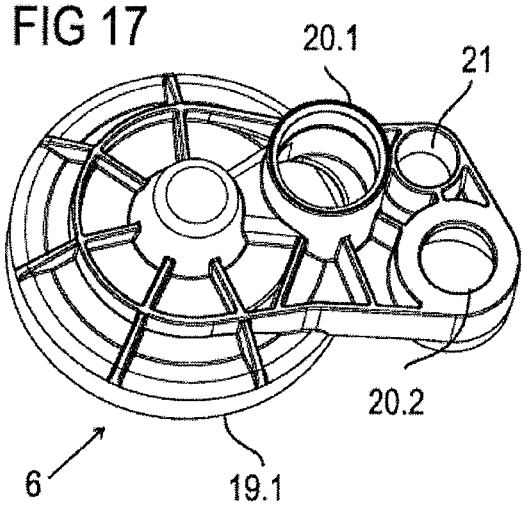
FIG. 17-FIG. 18: Exemplary variant of a cartridge coupling in different 3D views.
Figure 18:
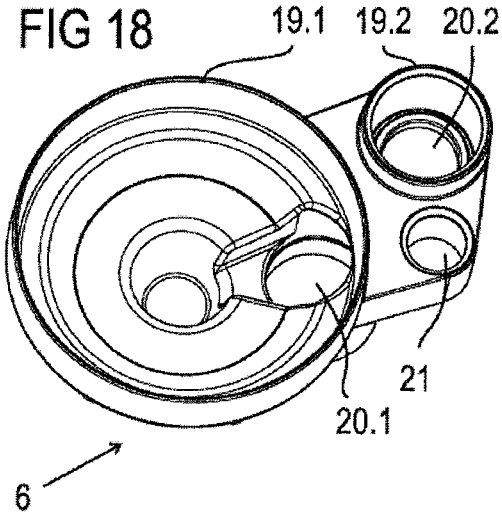

In FIGS. 15 and 16, the two outlet openings 20.1 and 20.2 including the drive train aperture 21 are arranged on a line, while in the embodiment in FIGS. 17 and 18 of the cartridge coupling, these openings form a triangle, so that a more compact embodiment of the entire metering and mixing device is achieved.

Overall, the disclosure proposes an exemplary metering and mixing device, such as for multi-component adhesives, in which the various cartridges of hollow cylindrical shape each contain substance components, and wherein a discharging device for simultaneously discharging the substance components via a mixing device are provided. According to an exemplary embodiment, at least one discharging piston has a thread which is in contact with a wall of the cartridge, so that a rotation of the driving piston can generate a forward driving of the discharging piston.

Exemplary combinations of features described herein can be particularly advantageous; for example:

I. Metering and mixing device for multi-component substances, such as multi-component adhesives, comprising:

I.a at least two associated cartridge accommodating devices for accommodating replaceable cartridges with separate substance components, I.b a discharging device for discharging (e.g., simultaneously discharging) the substance components from the cartridges through the component outlets by means of discharging pistons that plunge into the cartridge accommodation device or the cartridges, I.c a mixing device which is connected to the component outlets, which mixes the discharged substance components and discharges them in the mixed state, wherein I.d at least one discharging piston has a thread which can drive the discharging piston forward by a rotation.

II. Metering and mixing device according to the previous combination of features I, wherein at least one cartridge is a hollow cylinder in which at least one substance component is located.

III. Metering and mixing device according to the previous combination of features II, wherein the thread of the at least one discharging piston with thread is in contact with a wall of the at least one cartridge of hollow cylindrical shape.

IV. Metering and mixing device according to any of the previous combinations of features I and II, wherein at least one cartridge is a tubular bag in which at least one substance component is located.

V. Metering and mixing device according to the previous combination of features IV, wherein the thread of the at least one discharging piston for a cartridge accommodating device in which a tubular bag can be inserted as cartridge is in contact with a wall of the cartridge accommodating device.

VI. Metering and mixing device according to any of the previous combinations of features I-V, wherein at least one cartridge accommodating device comprises a hollow cylinder.

VII. Metering and mixing device according to any of the previous combinations of features I-V, wherein at least one cartridge accommodating device comprises at least three cylindrically arranged bar-like supports.

VIII. Metering and mixing device according to any of the previous combinations of features I-VII, wherein at least one discharging piston has an outer thread.

IX. Metering and mixing device according to the previous combination of features VIII, wherein, in the at least one cartridge accommodating device or cartridge in which the at least one discharging piston having an outer thread is located, and a negative thread with respect to the outer thread of the discharging piston is present.

X. Metering and mixing device according to any of the previous combinations of features I-IX, wherein the thread of the at least one discharging piston is designed so that it is self cutting, in such a manner that it itself cuts or punches a negative thread into the cartridge accommodating device or the cartridge.

XI. Metering and mixing device according to any of the previous combinations of features I-X, wherein at least one discharging piston comprises a linearly forward driven discharge bar.

XII. Metering and mixing device according to the previous combination of features XI, wherein the linearly forward driven discharge bar has a regular toothing, with which a gear wheel or a spindle thread for the forward driving can engage.

XIII. Metering and mixing device according to the previous combination of features XI, wherein the linearly driven discharge bar has a spindle thread with which a toothing can engage.

XIV. Metering and mixing device according to any of the previous combinations of features I-XIII, wherein at least one drive for driving the discharging piston is provided.

XV. Metering and mixing device according to any of the previous combinations of features I-XIII, wherein a common gear drive with a drive input and several drive outputs is provided for driving at least the driving piston.

XVI. Metering and mixing device according to any of the previous combinations of features XIV-XV, wherein, with the at least one gear drive, at least one linearly movable discharging piston and at least one discharging piston that can be moved in rotation are connected.

XVII. Metering and mixing device according to any of the previous combinations of features I-XVI, wherein the mixing device is configured as a passive or a static mixer.

XVIII. Metering and mixing device according to any of the previous combinations of features I-XVI, wherein the mixing device is configured as an active or a dynamic mixer, such as a rotary mixer.

XIX. Metering and mixing device according to the previous combination of features XVIII, wherein the active or the dynamic mixer is connected to a gear drive, such as to the gear drive for driving the discharging piston.

XX. Metering and mixing device according to any of the previous combinations of features I-XIX, wherein at least one of the driving pistons comprises a ventilation device.

XXI. Metering and mixing device according to any of the previous combinations of features I-XIX, wherein at least one of the cartridge accommodating devices or cartridges comprises a ventilation device.

XXII. Metering and mixing device according to the previous combination of features XXI, wherein, as a ventilation device, in the rear portion of the inner side of the at least one cartridge accommodating device or cartridge, at least one ventilation groove is countersunk.

XXIII. Metering and mixing device according to any of the previous combinations of features I-XXII, wherein at least two of the cartridge accommodating devices have different lengths.

XXIV. Metering and mixing device according to any of the previous combinations of features I-XXIII, wherein at least two of the cartridge accommodating devices have different diameters.

XXV. Metering and mixing device according to any of the previous combinations of features XIV-XXIV, wherein the at least one gear drive is driven by motor, such as by an electric motor.

XXVI. Metering and mixing device according to any of the previous combinations of features I-XXV, wherein the cartridge accommodating devices are connected to discharging pistons to form a unit, and the mixer and the at least one gear drive are configured so that they can be attached or docked or clipped on separately.

Thus, it will be appreciated by those skilled in the art that the present disclosure can be embodied in other specific forms without departing from the spirit or essential characteristics thereof. The presently disclosed embodiments are therefore considered in all respects to be illustrative and not restricted. The scope of the disclosure is indicated by the appended claims rather than the foregoing description and all changes that come within the meaning and range and equivalence thereof are intended to be embraced therein.

LIST OF REFERENCE NUMERALS

1 Metering and mixing device
2 Large cartridge accommodating device
2.1 Tubular bag
3 Small cartridge accommodating device
3.1 Small hard cylindrical cartridge
4 Toothed bar
5 Rotary shaft for rotary piston/driving piston in the form of a rotary piston with gear drive
6 Cartridge coupling
7 Active rotary mixer
8 Gear drive
9 E-motor
10 Drive shaft for rotary mixer
11 Rotary piston
11.1 Thread
11.2 Delimitation for O-ring
11.3 Seal
11.4 Air inclusion area
12 Discharge spout
13 Closure
14 Ventilation groove
16 Linear pistons
17 Discharge tip
18 O-ring
19.1 Insertion flange
19.2 Insertion flange
20.1 Outlet opening
20.2 Outlet opening
21 Drive train aperture

What is claimed is:

1. A metering and mixing device for a multi-component substance, comprising:

at least two associated cartridge accommodating devices for accommodating replaceable cartridges having individual substance components;

a discharging device for discharging the substance components from cartridges through component outlets by means of discharging pistons that plunge into the cartridge accommodating device or cartridges; and a mixing device, which is connected to the component outlets, for mixing the discharge substance components, and outputting them in a mixed state, wherein:

at least one of the discharging pistons has a thread such that the discharging piston will be driven forward by the thread when the discharging piston is rotated relative to the cartridge accommodating device.

2. The metering and mixing device according to claim 1, comprising:

at least one cartridge, the at least one cartridge being configured as a tubular bag in which at least one substance component is located.

3. The metering and mixing device according to claim 1, wherein at least one cartridge accommodating device comprises:

a hollow cylinder.

4. The metering and mixing device according to claim 1, wherein at least one of the discharging pistons comprises:

a ventilation device.

5. The metering and mixing device according to claim 1, wherein the multi-component substance is an adhesive.

6. The metering and mixing device according to claim 1, wherein at least one discharging piston has an outer thread.

7. The metering and mixing device according to claim 6, comprising:

at least one cartridge accommodating device or cartridge in which the at least one discharging piston is located.

8. The metering and mixing device according to claim 1, wherein at least one of the cartridge accommodating devices or a cartridge inserted therein comprises:

a ventilation device.

9. The metering and mixing device according to claim 8, wherein, as the ventilation device, in a rear portion of an inner side of the at least one cartridge accommodating device or cartridge, at least one ventilation groove is countersunk.

10. The metering and mixing device according to claim 1, wherein the at least one of the discharging pistons comprises:

a linearly forward driven discharge bar.

11. The metering and mixing device according to claim 10, wherein the linearly forward driven discharge bar comprises:

a toothing with which a gear wheel or a thread can engage for forward driving the at least one discharging piston.

12. The metering and mixing device according to claim 10, wherein the linearly forward driven discharge bar comprises:

a thread with which a toothing can engage.

13. The metering and mixing device according to claim 1, comprising:

at least one cartridge, the at least one cartridge being a hollow cylinder in which at least one substance component is located.

14. The metering and mixing device according to claim 13, wherein the thread of the at least one discharging piston is in contact with a wall of the at least one cartridge.

15. The metering and mixing device according to claim 14, wherein at least one cartridge accommodating device comprises:

a hollow cylinder.

16. The metering and mixing device according to claim 15, wherein at least one discharging piston has an outer thread.

17. The metering and mixing device according to claim 16, wherein the thread of at least one of the discharging pistons is configured to be self-cutting, such that it itself cuts or punches a negative thread into the cartridge accommodating device or into a cartridge when inserted.

18. The metering and mixing device according to claim 17, wherein at least one of the discharging piston comprises:

a linearly forward driven discharge bar.

19. The metering and mixing device according to claim 18, wherein at least one of the at least one discharging pistons comprises:

a ventilation device.

20. The metering and mixing device according to claim 18, wherein at least one of the cartridge accommodating devices or a cartridge inserted therein comprises:

a ventilation device.

* * * * *